US010654097B2

(12) United States Patent
Sugiyama et al.

(10) Patent No.: US 10,654,097 B2
(45) Date of Patent: May 19, 2020

(54) LOW-PRESSURE CASTING MOLD

(71) Applicant: NISSAN MOTOR CO., LTD., Yokohama-shi, Kanagawa (JP)

(72) Inventors: Yuta Sugiyama, Kanagawa (JP); Kenji Mizukoshi, Kanagawa (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 0 days.

(21) Appl. No.: 16/307,222

(22) PCT Filed: Jun. 8, 2016

(86) PCT No.: PCT/JP2016/067032

§ 371 (c)(1),
(2) Date: Dec. 5, 2018

(87) PCT Pub. No.: WO2017/212565

PCT Pub. Date: Dec. 14, 2017

(65) Prior Publication Data

US 2019/0217378 A1 Jul. 18, 2019

(51) Int. Cl.

| | |
|---|---|
| ***B22C 9/08*** | (2006.01) |
| ***B22D 18/04*** | (2006.01) |
| *B22D 2/00* | (2006.01) |
| *B22D 27/04* | (2006.01) |

(52) U.S. Cl.
CPC ..... *B22C 9/082* (2013.01); *B22D 18/04* (2013.01); *B22D 2/00* (2013.01); *B22D 27/04* (2013.01); *F02F 2200/06* (2013.01)

(58) Field of Classification Search
CPC ..... B22C 9/082; B22D 18/04; B22D 2/00; B22D 27/04
See application file for complete search history.

(56) References Cited

U.S. PATENT DOCUMENTS

| | | | | |
|---|---|---|---|---|
| 4,076,070 | A * | 2/1978 | Lefebvre | B22D 18/04 164/303 |
| 5,611,388 | A * | 3/1997 | Fukuoka | B22C 9/061 164/119 |
| 2005/0092457 | A1 | 5/2005 | Park | |
| 2009/0255643 | A1 | 10/2009 | Kweon | |

FOREIGN PATENT DOCUMENTS

| | | |
|---|---|---|
| CN | 201922023 U | 8/2011 |
| CN | 203003119 U | 6/2013 |
| JP | 57-116365 U1 | 7/1982 |

(Continued)

*Primary Examiner* — Kevin P Kerns
*Assistant Examiner* — Steven S Ha
(74) *Attorney, Agent, or Firm* — Foley & Lardner LLP

(57) ABSTRACT

A low-pressure casting mold includes at least upper and lower molds 4U, 4L forming a cavity 3 and sprue pieces 8, 9 that have cylindrical shapes and that are disposed at different positions of the lower mold 4L. The sprue pieces 8, 9 include sprues 8A, 9A open to the cavity 3 and basins 8B, 9B, and the basins 8B, 9B have different volumes according to the position of the sprue pieces in the lower mold 4. Equalization of the solidification time of molten metal at the sprues 8A, 9A is achieved along with the less influence on the structure of the lower mold 4L and a stalk and the improved flexibility in apparatus design.

6 Claims, 10 Drawing Sheets

(56) References Cited

FOREIGN PATENT DOCUMENTS

| | | | | |
|---|---|---|---|---|
| JP | 04-361850 | A | | 12/1992 |
| JP | 2006-175479 | A | | 7/2006 |
| JP | 2009090303 | A | * | 4/2009 |
| JP | 2010-194585 | A | | 9/2010 |
| JP | 2016-132028 | A | | 7/2016 |
| WO | WO-2016/088256 | A1 | | 6/2016 |

* cited by examiner

LOW-PRESSURE CASTING MOLD

TECHNICAL FIELD

The present invention relates to a low-pressure casting mold having a heat controlling function.

BACKGROUND ART

One of conventional casting molds is described in, for example, Patent Document 1. The casting apparatus described in Patent Document 1 is a low-pressure casting apparatus, which comprises an upper mold and a lower mold that form a casting cavity, a plurality of runners disposed in the lower mold and respective sprues from a stalk at a lower side to the runners at an upper side. Further, the sprues have different heights, and the casting apparatus further comprises a pre-heating means at an outer periphery of each of the sprues. In order to improve the releasability and the casting quality of the casting products, the temperature is controlled so that solidification of molten metal is completed approximately at the same time between the runners.

CITATION LIST

Patent Document

JP H 04-361850A

SUMMARY OF INVENTION

Technical Problem

However, in conventional casting apparatuses as described above, since the sprues have different heights, the difference in height of the sprues inevitably affects the structure of the lower mold with the runners, the overall mold and the stalk. That is, a problem with such conventional casting apparatuses is the poor flexibility in apparatus design, which may lead to a difficulty in developing a casting design or a limitation of the shape of casting products. Therefore, it has been required to solve the problem.

The present invention has been made in view of the problem in the prior art, and an object thereof is to provide a low-pressure casting mold with sprues at different positions that has high flexibility in apparatus design and that can achieve equalization of the solidification time of molten metal at the sprues.

Solution to Problem

The low-pressure casting mold according to the present invention comprises at least upper and lower molds that form a cavity and sprue pieces that have cylindrical shapes and that are disposed at different positions of the lower mold. In the low-pressure casting mold, each of the sprue pieces comprises a sprue open to the cavity at an upper side and a basin under the sprue, and the basin has different volume according to the position of each of the sprue pieces in the lower mold. This configuration offers a solution to the problems in the prior art.

Advantageous Effects of Invention

In the low-pressure casting mold according to the present invention, the sprue pieces at different positions have respective basins with different volumes. Accordingly, at a sprue piece having a basin with relatively large volume, the molten metal in the basin has a large amount of heat, and the solidification time of the molten metal in the sprue is relatively long. In contrast, at a sprue piece having a basin with relatively small volume, the molten metal in the basin has a small amount of heat, and the solidification time of the molten metal in the sprue is relatively short.

In the low-pressure casting mold, the basins of the sprue pieces have different volumes, and this configuration has a small or no influence on the structure of the lower mold and the overall mold or the stalk, and the apparatus design is highly flexible. Therefore, in addition to the high flexibility in apparatus design, the low-pressure casting mold can achieve equalization of the solidification time of molten metals between the sprues at different positions.

DESCRIPTION OF EMBODIMENTS

First Embodiment

Figure 1:
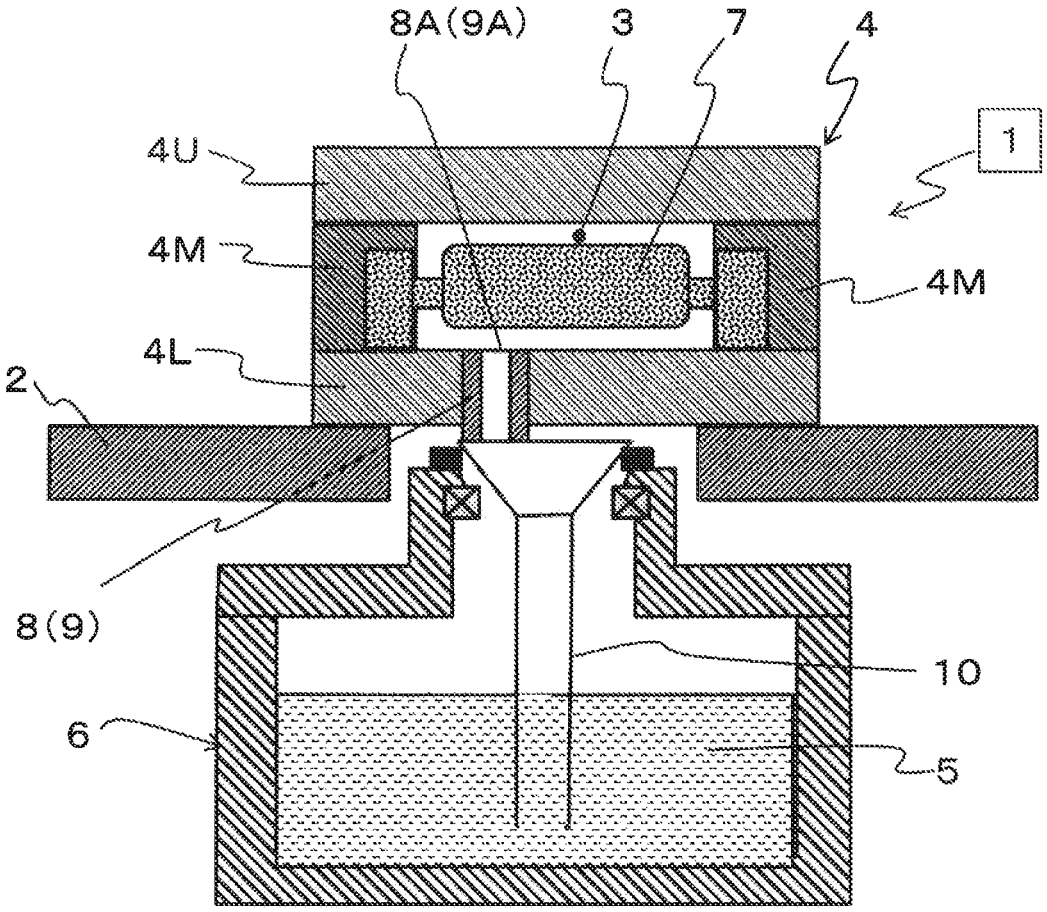
FIG. 1 is a cross-sectional view of a low-pressure casting apparatus to which the low-pressure casting mold according to the present invention is applicable.

A low-pressure casting apparatus 1 in FIG. 1 is an apparatus to which the low-pressure casting mold according to the present invention is applicable. The low-pressure casting apparatus 1 comprises a mold body (casting mold, molding die) 4 that is disposed on a base table 2 to form a cavity 3 as a casting room, and a holding furnace 6 which is disposed below the base table 2 to store molten metal 5. In the following description, the mold body 4 is referred to simply as the "mold 4".

The mold 4 comprises an upper mold 4U that is elevatable, a lower mold 4L fixed to the base table 2 and middle molds 4M that are laterally movable. In the illustrated example, cores 7 are disposed in the cavities 3. In the lower mold 4L, sprue pieces 8 (9) having cylindrical shapes are disposed to form sprues 8A (9A).

The holding furnace 6 comprises a stalk 10 that serves as a supply route of the molten metal 5 to the mold 4. A lower end of the stalk 10 is dipped in the molten metal 5 while an upper end thereof is communicated with the sprues 8A (9A). Although not shown in the figure, the holding furnace 6 comprises a gas supplier for supplying a pressurizing gas to the inner space, a heater for heating the molten metal 5, and the like.

The low-pressure casting apparatus 1 compresses and supplies gas to the inner space of the holding furnace 6 so as to supply the molten metal 5 to the cavity 3 through the stalk 10 and the sprues 8A. In the low-pressure casting apparatus 1, after the molten metal 5 solidifies, the mold 4 is opened to collect a casting product (molded product).

The low-pressure casting mold according to the present invention is applicable as the mold 4 of the above-described low-pressure casting apparatus 1. The embodiment illustrates an example in which the low-pressure casting mold is applied as the lower mold 4L of the mold 4. That is, as the basic configuration, the low-pressure casting mold comprises at least the upper and lower mold 4U, 4L that form the cavity 3, and the sprue pieces 8, 9 having cylindrical shapes and disposed at different positions of the lower mold 4L as illustrated in FIG. 2.

In the embodiment, the casting product is a cylinder head CH of an internal-combustion engine. The mold 4 including the lower mold 4L in FIG. 2 casts two cylinder heads CH at a time. The cavities 3 and the cores 7 correspond to the inner and outer shapes of the cylinder heads CH. As schematically illustrated in FIG. 3, the mold 4 comprises combustion chamber forming portions CF for forming combustion chambers of the cylinder heads CH, and the sprue pieces 8, 9 are disposed near the combustion chamber forming portions CF.

Figure 2:
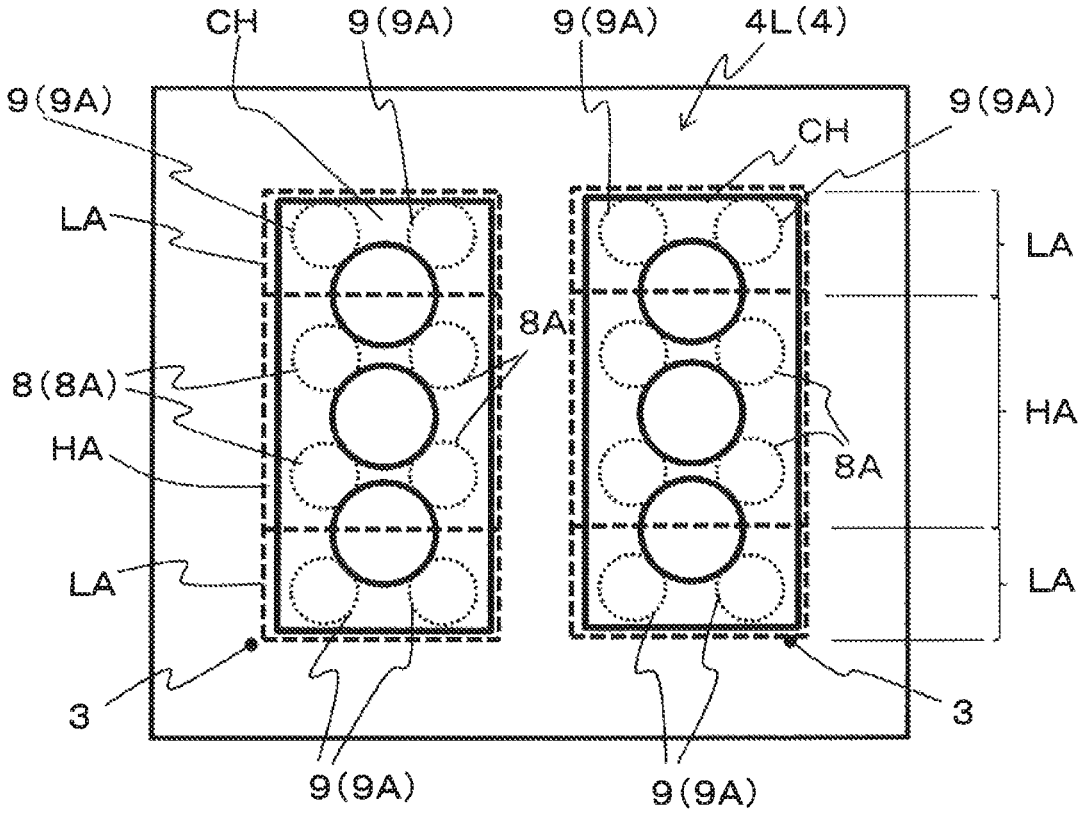
FIG. 2 is a plan view of a lower mold and a casting product of a low-pressure casting mold according to a first embodiment.
Figure 3:
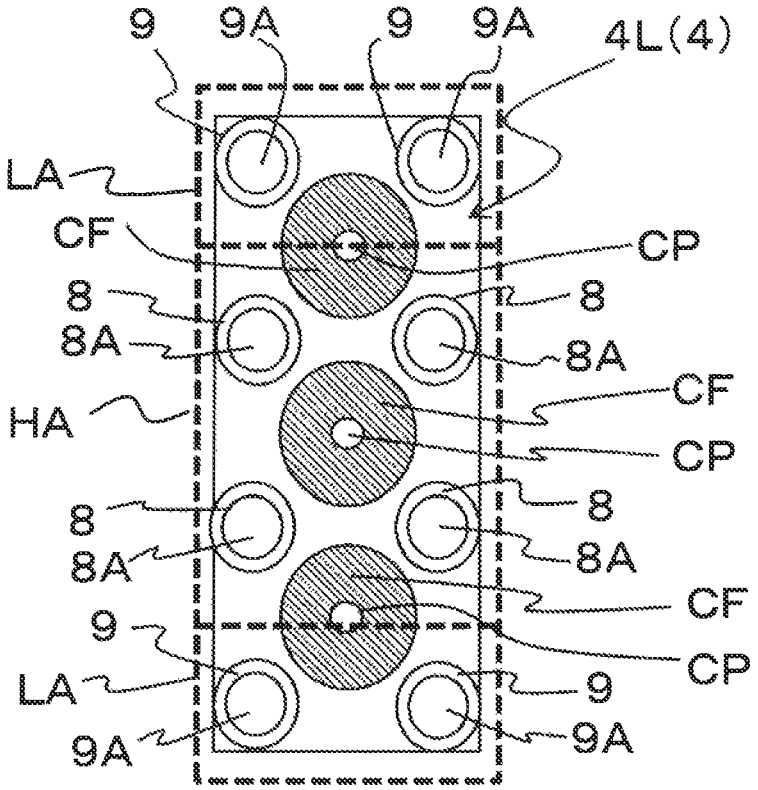
FIG. 3 is a plan view illustrating the arrangement of sprues and a combustion chamber forming portion.

Each of the cylinder heads CH in FIG. 2 is a straight-three engine. Accordingly, three combustion chamber forming portions CF are arranged in a line in the mold 4 in FIG. 3. Further, a channel CP for a cooling medium is provided in each of the combustion chamber forming portions CF to actively cool the combustion chamber forming portions CF during casting. This is intended to obtain a dense material structure around the combustion chambers by cooling so as to improve the mechanical properties. In the lower mold 4L, eight sprue pieces 8, 9 in total are provided such that four sprues 8A, 9A are disposed around each of the combustion chamber forming portions CF.

As with low-pressure casting apparatus well-known in the art, a good-quality casting product can be obtained by using the mold 4 when the molten metal 5 is solidified sequentially from the opposite side of the sprues to the sprues 8A, 9A after the cavity 3 is filled with the molten metal 5. That is, it is necessary to maintain a higher temperature at the sprues 8A, 9A, where the molten metal 5 is solidified last, than the other portions.

In the mold 4, a center area apart from the outside air normally tends to have higher temperature. As illustrated by a dashed-line rectangular frame in FIG. 2 and FIG. 3, the center area of the mold 4 corresponds to a high-temperature area HA having relatively high temperature, and end areas at both sides thereof correspond to low-temperature areas LA, LA having relatively low temperature. Accordingly, the solidification time of the molten metal 5 at the sprues 8A, 9A differs between the high-temperature area HA and the low-temperature areas LA.

Figure 4:
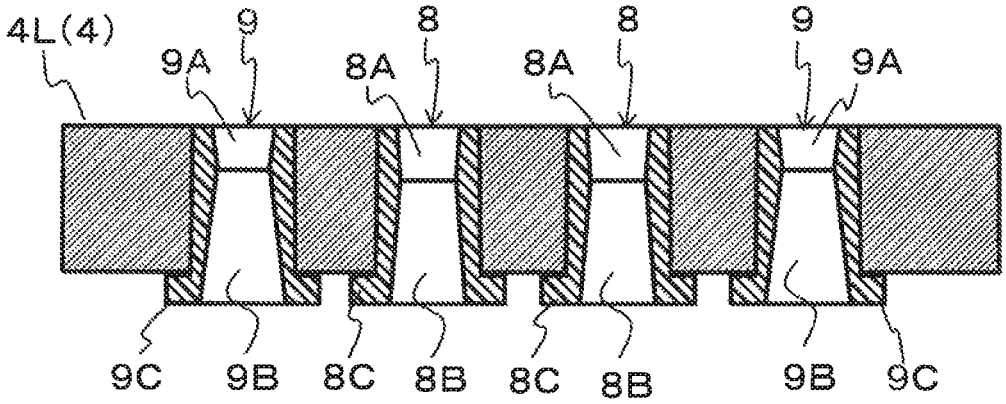
FIG. 4 is a cross-sectional view of the lower mold in FIG. 2.
Figure 5:
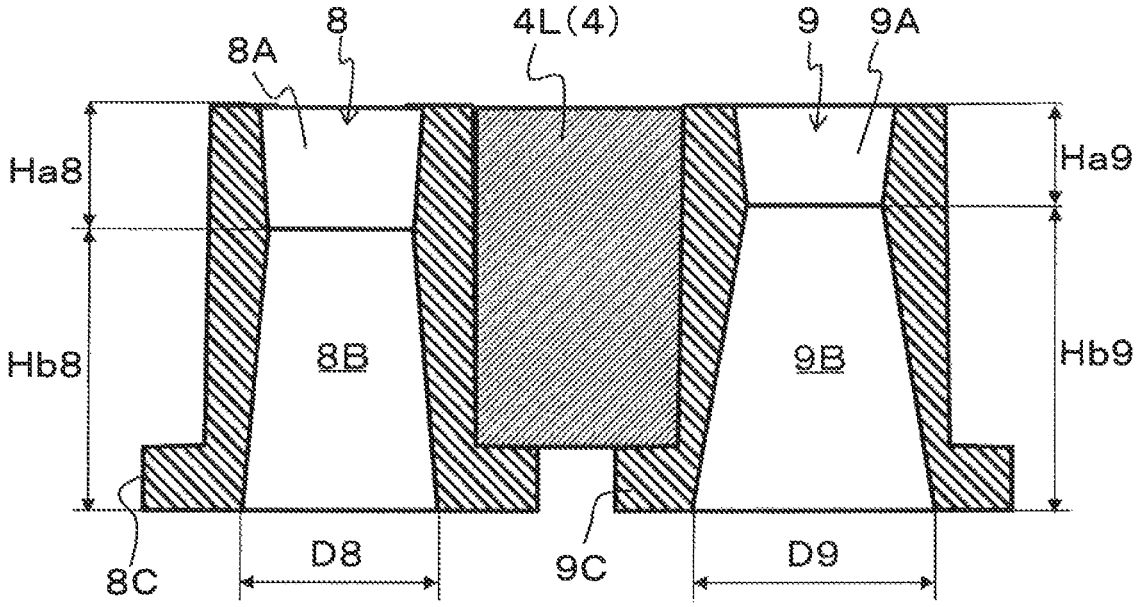
FIG. 5 is an enlarged cross-sectional view of center area sprue pieces and end area sprue pieces illustrated in FIG. 4.

To avoid this, the sprue pieces 8, 9 are devised as follows in the mold 4. The sprue pieces 8, 9, which have cylindrical shapes as described above, have sprues 8A, 9A open to the cavity 3 at an upper side, the basins 8B, 9B under the sprues 8A, 9A and flanges 8C, 9C at the peripheries of lower ends of the sprue pieces 8, 9 as illustrated in FIG. 4 and FIG. 5.

The sprues 8A, 9A are spaces with a diameter that gradually increases toward the upper side. Further, the basins 8B, 9B are spaces with a diameter that gradually increases toward the lower side. Accordingly, the sprue pieces 8, 9 have cylindrical spaces that have the respective minimum diameters at the respective boundaries between the sprues 8A, 9A and the basins 8B, 9B. With these spaces, the sprue pieces 8, 9 surely separate solidified material in the sprues 8A, 9A from the molten metal in the basins 8B, 9B to facilitate releasing a casting product.

In the mold 4, the sprue pieces 8, 9 includes center area sprue pieces 8 that are sprue pieces disposed in the center area of the cavity 3 among the sprue pieces 8, 9 and end area sprue pieces 9 that are sprue pieces disposed in the end areas of the cavity 3 among the sprue pieces 8, 9. That is, in the lower mold 4L in FIG. 2, four center area sprue pieces 8 are disposed in the high-temperature area HA, which corresponds to the center area, and two end area sprue pieces 9 are disposed in each of the low-temperature areas LA, LA at opposite sides, which correspond to the end areas.

In the sprue pieces 8, 9, the basins 8B, 9B have different volumes according to the position of the sprue pieces in the lower mold 4L. To be more specific, the height Hb9 of the basins 9B of the end area sprue pieces 9, one of which is illustrated at the right side in FIG. 5, is relatively greater than the height Hb8 of the basins 8B of the center area sprue pieces 8 in the high-temperature area HA, one of which is illustrated at the left side in FIG. 5, so that the basins 8B, 9B have different volumes.

The sprue pieces 8, 9 of the illustrated example have the same outer dimension. According to the above-described configuration of the height Hb8, Hb9 of the basins 8B, 9B, the height Ha9 of the end area sprue pieces 9 is relatively less than the height Ha8 of the sprues 8A of the center area sprue pieces 8.

That is, in the mold 4 of the embodiment, the center area sprue pieces 8 have the same outer dimension as the end area sprue pieces 9 while the sprues 8A, 9A and the basins 8B, 9B have different volumes so that the volume (height Ha8, Ha9) of the sprues 8A, 9A is inversely proportional to the volume (height Hb8, Hb9) of the basins 8B, 9B. In other words, the center area sprue pieces 8 and the end area sprue pieces 9 have the same outer dimension since the volume of the sprues 8A, 9A is inversely proportional to the volume of the basins 81, 9B.

In a more preferred embodiment, each of the sprue pieces 8, 9 may have different size from the others in at least one of the height Ha8, Ha9 of the sprue 8A, 9A, the inner diameter D8, D9 of the basin and the volume and the shape of the sprue piece itself in addition to the height Hb8, Hb9 of the basin 8B, 9B. Depending on the figure and the like of the casting product, each of the sprue pieces 8, 9 may have different size from the others in the above-described dimensions but the same size in the outer dimension, or each of the sprue pieces 8, 9 may have different size from the others in the above-described dimensions in addition to the outer dimension. In this way, the volume of the basin 8B, 9B of each of the sprue pieces 8, 9 is set.

In the low-pressure casting apparatus in FIG. 1, which comprises the mold 4 having the above-described configuration, a gas is supplied to the inner space of the holding furnace 6 by pressure so that the molten metal 5 is supplied to the cavity 3 through the sprue pieces 8, 9 and the stalk 10.

Thereafter, in the mold 4, the molten metal 5 in the cavity 3 gradually solidifies from the opposite side of the sprues toward the sprues 8A, 9A. In this regard, the basins 8B, 9B of the sprue pieces 8, 9 have different volumes. Accordingly, at the end area sprue pieces 9, which comprise the basins 8B having relatively large volume, the molten metal 5 in the basins 9B have a large amount of heat, and the solidification time of the molten metal 5 in the sprues 9A is relatively long. That is, the molten metal 5 is generally cooled down (solidifies) fast at the sprues 9A in the low-temperature areas LA. To avoid this, in the mold 4, the amount of heat in the basins 9B of the end area sprue pieces 9 in the low-temperature areas LA is relatively increased so that the solidification time is extended.

In contrast, at the center area sprue pieces 8 in the high-temperature area HA where the basins 9B has a height relatively low, the amount of heat of the molten metal 5 in the basins 8B is small, and the solidification time of the molten metal 5 in the sprues 8A is relatively short. That is, the molten metal 5 is generally cooled down (solidifies) slowly at the sprues 8A in the high-temperature area HA. To avoid this, in the mold 4, the amount of heat in the basins 8B of the center area sprue pieces 8 in the high-temperature area HA is relatively decreased so that the solidification time is reduced.

In this way, equalization of the solidification time of the molten metal between the sprues 8A, 9A at different positions of the lower mold 4L can be achieved in the low-pressure casting mold. To achieve equalization of the solidification time at the sprues 8A, 9A, the low-pressure casting mold is configured such that the basins 8B, 9B of the sprue pieces 8, 9 have different volumes. Therefore, this configuration of the low-pressure casting mold has a small or no influence on the structure of the lower mold 4L and the overall mold 4 and the stalk 10.

As a result, the low-pressure casting mold has high flexibility in apparatus design, and equalization of the solidification time of the molten metal in the sprues at different positions can be achieved. Further, along with the improvement of the flexibility in apparatus design, the low-pressure casting mold can ease the difficulty in developing a casting design and the limitation of the shape of casting products.

The low-pressure casting mold, in which the sprues 8A, 9A are at different positions, can reduce the filling time of the cavity 3 with the molten metal 5 and thereby reduce the casting cycle time. Furthermore, with the low-pressure casting mold, it is possible to obtain a good-quality casting product with no defective shape or blowhole at an unsolidified portion by equalizing the solidification time at the sprues 8A, 9A. In the embodiment, it is possible to obtain a good-quality cylinder head CH.

In the low-pressure casting mold, the sprues 8A, 9A and the basins 8B, 9B have different volumes in each of the center area sprue pieces 8 disposed in the high-temperature area HA and the end area sprue pieces 9 in the low-temperature area LA, and the volume of the sprues 8A, 9A is inversely proportional to the volume of the basins 8B, 9B. In the low-pressure casting mold, this allows the sprue pieces 8, 9 to be formed in the same (common) outer shape or outer dimension so as to reduce the influence on the structure of the mold 4 including the lower mold 4L and the stalk 10 and to further improve the flexibility in apparatus design.

In the low-pressure casting mold, each of the sprue pieces 8, 9 has different size from the others in at least one of the height Hb8, Hb9 of the basin 8B, 9B, the height Ha8, Ha9 of the sprue 8A, 9A, the inner diameter D8, D9 of the lower end of the basin 8B, 9B and the volume and the shape of the piece itself. This configuration of the low-pressure casting mold allows setting the volume of the basins 8B, 9B and thereby precisely setting the solidification time of the molten metal 6 at the sprue pieces 8, 9. This can contribute to producing a casting product with a better quality.

FIG. 6 to FIG. 10 illustrate low-pressure casting molds according to second to fourth embodiments of the present invention. In the following embodiments, the same reference signs are denoted to the same components as those of the first embodiment, and the detailed description thereof is omitted.

Second Embodiment

Figure 6:
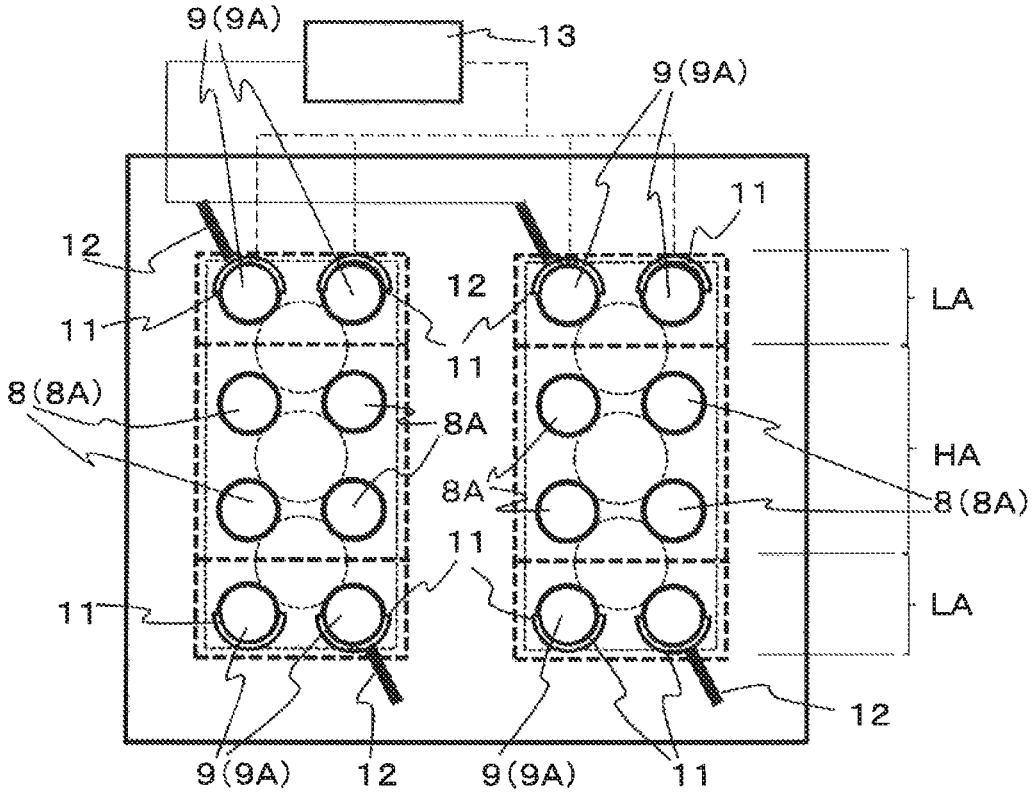
FIG. 6 is a plan view of a lower mold of a low-pressure casting mold according to a second embodiment.
Figure 7:
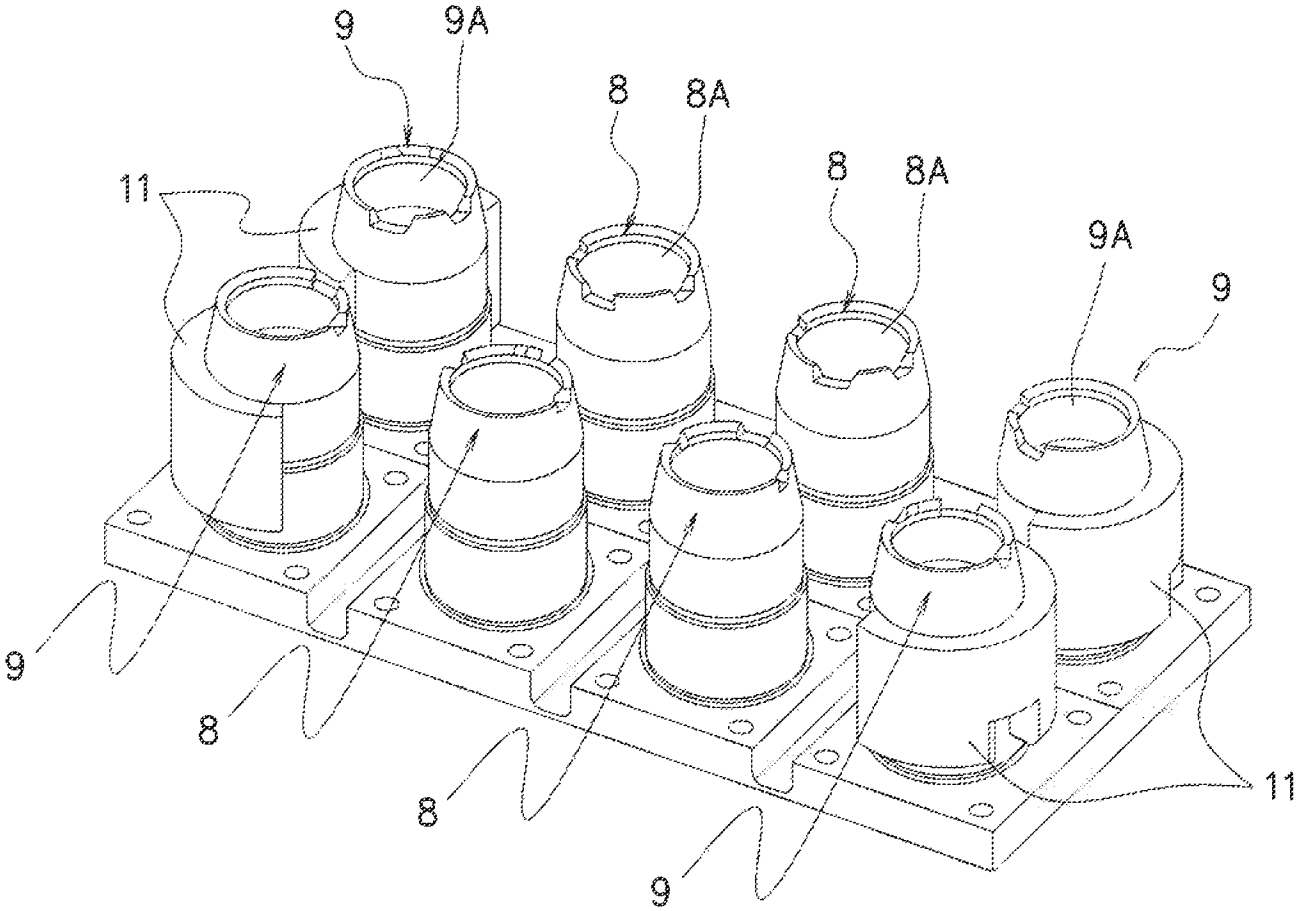
FIG. 7 is a perspective view illustrating the arrangement of sprues in the second embodiment.

The low-pressure casting mold in FIG. 6 and FIG. 7 comprises heaters 11 and temperature sensors 12 that are attached at least to end area sprue pieces 9 disposed in end areas (low-temperature areas LA) of a lower mold 4A, and a temperature controller 13 that is configured to operate the heaters 11 based on a measurement value of the temperature sensors 12. In FIG. 6, a connection line of the heaters 11 and the temperature sensors 12 attached to the end area sprue pieces 9 at the lower side is omitted, which is an input/output line to and from the temperature controller 13.

As with the first embodiment (see FIG. 2), the mold 4 of the illustrated example is designed to produce a straight-three cylinder head CH (illustrated by the dashed line), and eight sprue pieces 8, 9 are disposed at the lower mold 4L. Further, a center area of the mold 4 corresponds to a high-temperature area HA having relatively high temperature, and both side areas thereof correspond to low-temperature areas LA, LA having relatively low temperature.

In the low-pressure casting mold having the above-described configuration, the heaters 11 heat the end area sprue pieces 9 in the low-temperature areas LA, the temperature sensors 12 measure the temperature thereof, and the temperature controller 13 performs feed-back control of the heaters 11 based on the measurement value.

With this configuration of the low-pressure casting mold, more accurate temperature control is performed in addition to obtaining the same advantageous effects as the previously-described embodiment. By this temperature control in combination with setting the dimension of the sprue pieces 8, 9, further equalization of the solidification time of the molten metal at the sprues 8A, 9A can be achieved.

Third Embodiment

Figure 8:
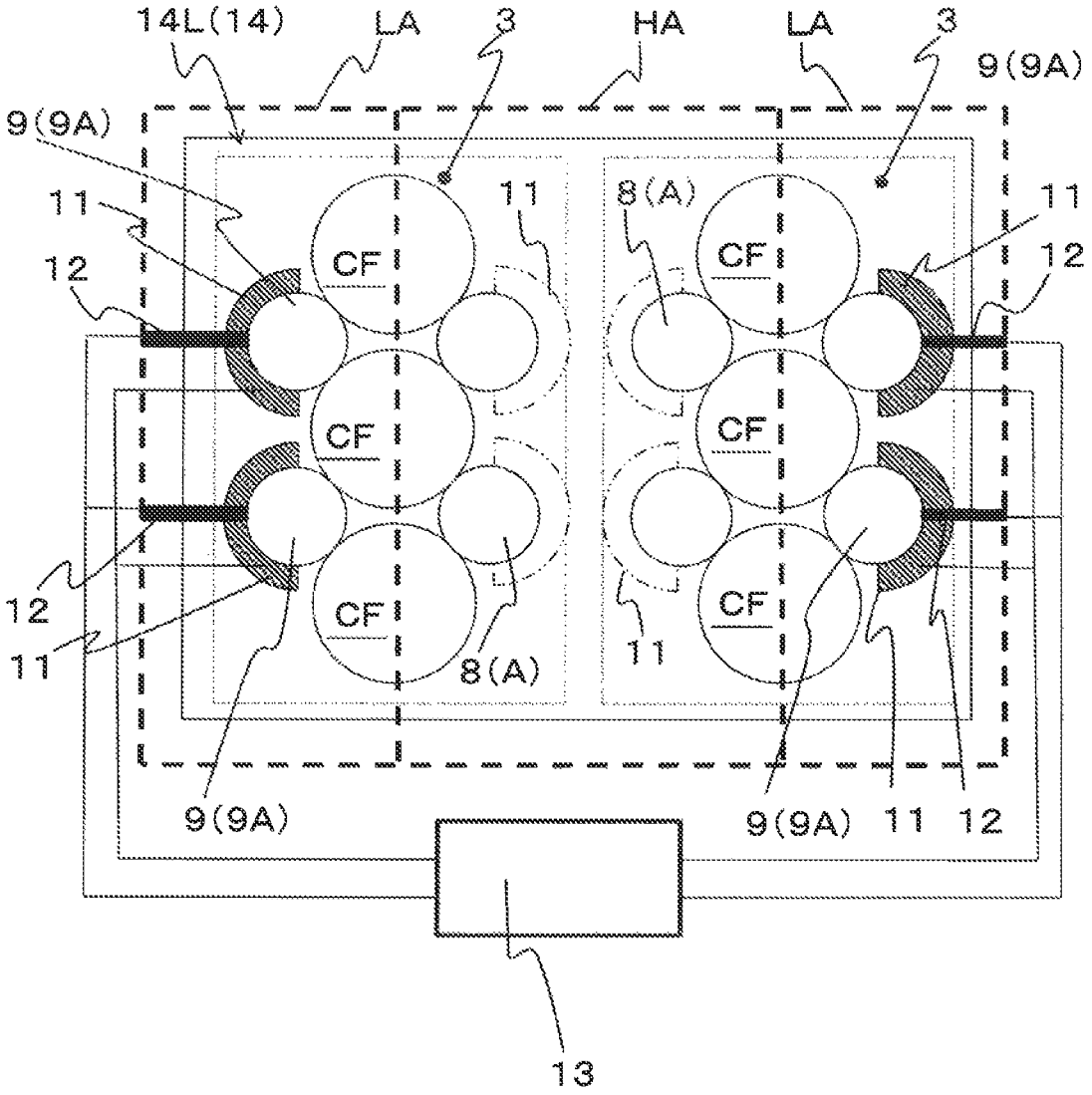
FIG. 8 is a plan view of a lower mold of a low-pressure casting mold according to a third embodiment.

The low-pressure casting mold in FIG. 8 comprises sprue pieces 8, 9 for forming sprues 8A, 9A at different positions of a lower mold 14L of the mold 14. The mold 14 of the illustrated example forms two cylinder heads at a time. Compared to the first and second embodiments (see FIG. 2 and FIG. 6), the respective cavities 3, 3 are disposed closely to each other.

The mold 14 is designed to form two straight-three cylinder blocks in a parallel arrangement, and four sprue pieces 8, 9 are disposed for each of three combustion chamber forming portions CF. In this configuration, since the cavities 3, 3 are close to each other in the mold 14, a center area in the middle of the cavities 3, 3 correspond to a high-temperature area HA, and end areas at the outer sides correspond to low-temperature areas LA.

Corresponding to this, the mold 14 comprises heaters 11 and temperature sensors 12 at end area sprue pieces 9 disposed in the low-temperature areas LA, and a temperature controller 13 that is configured to operate the heaters 11 based on a measurement value of the temperature sensors 12.

As in the second embodiment, in the low-pressure casting mold having the above-described configuration, the heaters 11 heat the end area sprue pieces 9 disposed in the low-temperature areas LA, the temperature sensors 12 measure the temperature thereof, and the temperature controller 13 perform feed-back control of the heaters 11 based on the measurement value. With this configuration, further equalization of the solidification time of molten metal at the sprues 8A, 9A can be achieved in the low-pressure casting mold in addition to producing the same advantageous effects as the previously-described embodiments.

In another embodiment, the heaters (partly illustrated by virtual lines) and the temperature sensors may be provided to all sprue pieces 8, 9 in the low-pressure casting mold in FIG. 8. In this mold 14, the heaters respectively heat all the sprue pieces 8, 9, the temperature sensors measure the temperature thereof, and the temperature controller perform feed-back control of the heaters based on the measurement value. With this configuration, more accurate temperature control can be performed, and further equalization of the solidification time of molten metal at the sprues 8A, 9A is achieved.

When the heaters 11 are provided to all the sprue pieces 8, 9, it is possible to simplify or omit setting the volume and the dimension of basins 8B, 9B of the sprue pieces 8, 9. Further equalization of the solidification time of the molten metal at the sprues 8A, 9A can be achieved even in such cases, and it is possible to reduce the filling time of the molten metal or the casting cycle time and to produce a good-quality casting product with no defective shape or blowhole at an unsolidified portion.

Fourth Embodiment

Figure 9:
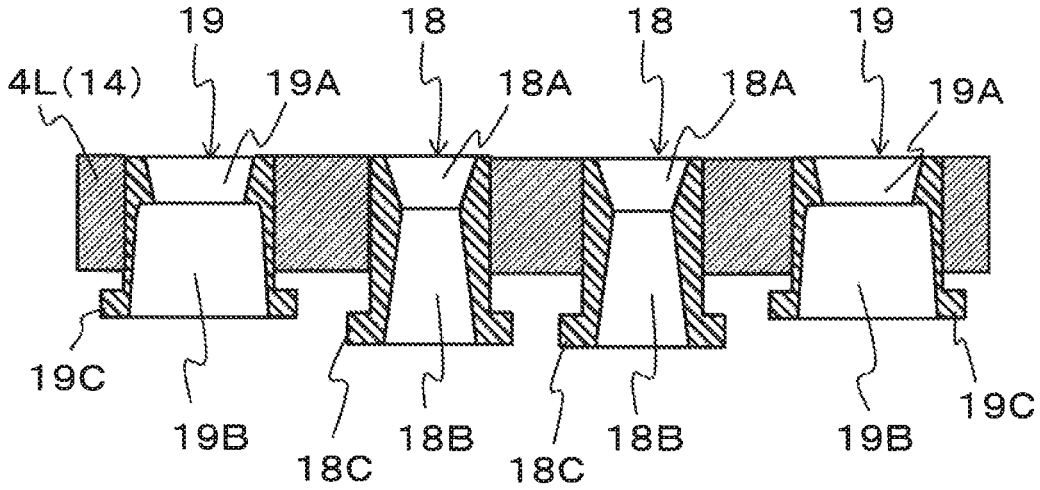
FIG. 9 is a cross-sectional view of a lower mold of a low-pressure casting mold according to a fourth embodiment.
Figure 10:
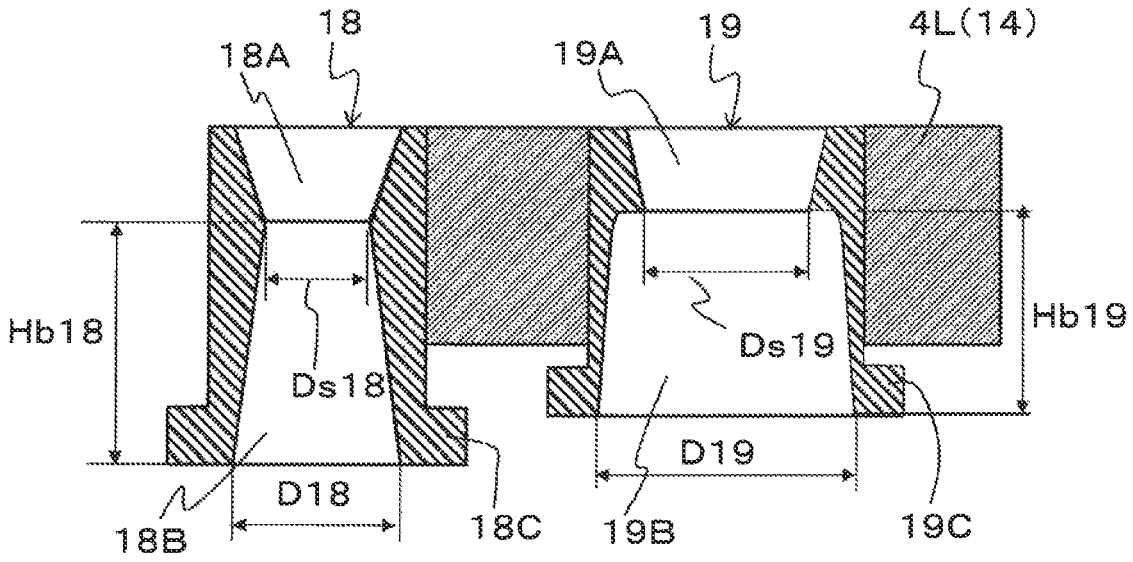
FIG. 10 is an enlarged cross-sectional view of center area sprue pieces and end area sprue pieces illustrated in FIG. 9.

The low-pressure casting mold in FIG. 9 and FIG. 10 comprises sprue pieces 18, 19 for forming sprues 18A, 19A at different positions of a lower mold 4L of a mold 4. As with the previously-described embodiments, the sprue pieces 18, 19 have cylindrical shapes but have different sizes in the volume of an inner space and the outer dimension.

To be more specific, the overall height and the height Hb18 of basins 18B are relatively large in center area sprue pieces 18 that are sprue pieces disposed in a center area (high-temperature area) among the sprue pieces 18 as illustrated in the left side of FIG. 10. Further, the inner diameter D18 of lower ends of the basins 18B and the minimum diameter Ds18 at the boundaries between the sprues 18A and the basins D9 are relatively small in the center area sprue pieces 18.

In contrast, the overall height and the height Hb19 of basins 19B are relatively small in end area sprue pieces 19 that are sprue pieces disposed in end areas (low-temperature areas) among the sprue pieces 19 as illustrated in the right side in FIG. 10. Further, the inner diameter D19 of lower ends of the basins 19B and the minimum diameter Ds19 at boundaries between the sprues 19A and the basins 19B are relatively large in the end area sprue pieces 19.

As described above, the sprue pieces 18, 19 are configured such that the end area sprue pieces 19 are smaller than the center area sprue pieces 18 with regard to the height, but the end area sprue pieces 19 are larger than the center area sprue pieces 18 with regard to the diameter. Accordingly, the sprue pieces 18, 19 have different volumes of the basins 18B, 19B, and the basins 19B of the end area sprue pieces 19 in the end areas (low-temperature areas) have relatively large volume.

As with the previously-described embodiments, in the low-pressure casting mold having the above-described configuration, the basins 18B, 19B of the sprue pieces 18, 19 have different volumes. In the end area sprue pieces 19 with respective basins 19B having relatively large volume, the molten metal in the basins 19B has a large amount of heat, and the solidification time of the molten metal is relatively long accordingly. In contrast, in the center area sprue pieces 18 with respective basins 18B having relatively small volume, the molten metal in the basins 18B has a small amount of heat, and the solidification time of the molten metal is relatively short accordingly.

In the low-pressure casting mold, the sprue pieces have respective basins with different volumes, and this configuration has a small or no influence on the structure of the lower mold 14L and the overall mold 14 and the stalk. Therefore, the low-pressure casting mold has high flexibility in apparatus design and can ease the difficulty in developing a casting design and the limitation of the shape of casting products. In addition to the high flexibility in apparatus design, equalization of the solidification time of the molten metal in the sprues at different positions can be achieved in the low-pressure casting mold.

Details of the configuration of the low-pressure casting mold of the present invention are not limited to these embodiments, and suitable changes can be made in the configuration without departing from the features of the present invention. The low-pressure casting mold of the present invention is applicable to low-pressure casting of various casting products.

REFERENCE SINGS LIST

3 Cavity
4 Mold
4L Lower mold
4U Upper mold
8 Center area sprue piece
8A, 9A Sprue
8B, 9B Basin
9 End area sprue piece
11 Heater
12 Temperature sensor
13 Temperature controller
14 Mold
14L Lower mold
18A, 19A Sprue
18B, 19B Basin
CH Cylinder head (casting product)

The invention claimed is:

1. A low-pressure casting mold, comprising:

at least an upper mold and a lower mold that form a cavity; and sprue pieces having cylindrical shapes and disposed at different positions of the lower mold, wherein each of the sprue pieces comprises a sprue open to the cavity at an upper side and a basin under the sprue, and the basin has different volume according to a position of each of the sprue pieces in the lower mold, wherein the sprue pieces comprise at least one center area sprue piece and end area sprue pieces that are disposed at a center area and end areas of the cavity, respectively, and each of the basins of the end area sprue pieces has a volume greater than the basin of the at least one center area sprue piece.

2. The low-pressure casting mold according to claim 1, wherein, in each of the at least one center area sprue piece and the end area sprue pieces, the sprue has a volume inversely proportional to the basin so that the sprue and the basin have different volumes.

3. The low-pressure casting mold according to claim 1, wherein a casting product to be molded in the cavity is a cylinder head of an internal combustion engine.

4. The low-pressure casting mold according to claim 1, wherein each of the sprue pieces has different size from other sprue pieces in at least one of height of the basin, inner diameter of the basin, a volume or a shape.

5. The low-pressure casting mold according to claim 1, further comprising:

a heater and a temperature sensor that are attached at least to at least one of the end area sprue pieces; and a temperature controller that is configured to operate the heater based on a measurement value of the temperature sensor.

6. A low-pressure casting mold, comprising:

at least an upper mold and a lower mold that form a cavity; and sprue pieces having cylindrical shapes and disposed at different positions of the lower mold, wherein each of the sprue pieces comprises a sprue open to the cavity at an upper side and a basin under the sprue, and the basin has different volume according to a position of each of the sprue pieces in the lower mold, and wherein each of the sprue pieces has different size from other sprue pieces in at least one of height of the basin, inner diameter of the basin, a volume or a shape.

* * * * *